US005639252A

United States Patent [19]

Despouys

[11] Patent Number: 5,639,252

[45] Date of Patent: Jun. 17, 1997

[54] HIGH-FREQUENCY ELECTRICAL CONNECTOR ALSO PROVIDING A SWITCHING FUNCTION

[75] Inventor: Jean-Bernard P. Despouys, Breancon, France

[73] Assignee: Radiall, Rosny-sous-Bois, France

[21] Appl. No.: 505,028

[22] Filed: Jul. 21, 1995

[30] Foreign Application Priority Data

Jul. 22, 1994 [FR] France ..... 94 09098

[51] Int. Cl.[6] ..... H01R 29/00

[52] U.S. Cl. ..... 439/188; 200/51.1

[58] Field of Search ..... 200/51.1; 439/188

[56] References Cited

U.S. PATENT DOCUMENTS

| | | | |
|---|---|---|---|
| 4,358,135 | 11/1982 | Tsuge et al. | 439/188 |
| 5,205,762 | 4/1993 | Carney | 439/607 |
| 5,267,868 | 12/1993 | Wolff, Jr. | 439/95 |

FOREIGN PATENT DOCUMENTS

| | | |
|---|---|---|
| 0499967 | 8/1992 | European Pat. Off. . |
| 0590544 | 9/1993 | European Pat. Off. . |
| 0601702 | 10/1993 | European Pat. Off. . |

*Primary Examiner*—Neil Abrams
*Assistant Examiner*—Barry Matthew L. Standig
*Attorney, Agent, or Firm*—Schweitzer Cornman Gross & Bondell LLP

[57] ABSTRACT

The invention relates to a high-frequency electrical connector which includes a first connector element comprising a first conductor and an earth conductor, and a second connector element comprising a second conductor, an earth conductor and a third conductor which is in electrical contact with the second conductor when the two connector elements are unmated, the first connector element being designed, when mating it with the second connector element, to move apart the said second and third conductors of the second connector element, the first (5), second (14) and third (16) conductors being made in the form of blades, the earth conductor of the first connector element (1) including an external sleeve (8) and a blade (6, 7) arranged substantially parallel to the blade (5) constituting the first conductor, the earth conductor of the second connector element (2) including an external sleeve (17) and a blade (15) arranged between the blades (14, 16) constituting the second and third conductors. The blade (5*a*) of the earth conductor of the first connector element is designed so as to be in contact with the third conductor (14) of the second connector element when the two connector elements are mated.

8 Claims, 2 Drawing Sheets

HIGH-FREQUENCY ELECTRICAL CONNECTOR ALSO PROVIDING A SWITCHING FUNCTION

BACKGROUND OF THE INVENTION

The present invention relates to a high-frequency electrical connector also providing a switching function.

Connectors, especially of the coaxial type, are already known which allow switching of one electrical line forming a high-frequency transmission channel to another electrical line forming a high-frequency transmission channel when the two elements of the connector are engaged one in the other.

Such connectors are, in particular, used for connecting portable apparatuses to their socket while at the same time switching electronic functions of the portable apparatus with those of the socket, as for example ear radio-telephones.

The known connectors generally have a complex structure and usually exhibit the major drawback of not providing good electromagnetic isolation between the two electrical lines to be switched.

An electrical connector is known, from EP-A-0,590,544, which includes a first connector element comprising a first conductor and an earth conductor, and a second connector element comprising a second conductor, an earth conductor and a third conductor which is in electrical contact with the second conductor when the two connector elements are unmated, the first connector element being designed, when mating it with the second connector element, to move apart the said second and third conductors of the second connector element, the first (5), second (14) and third (16) conductors being made in the form of blades, the earth conductor of the first connector element (1) including an external sleeve (8) and a blade (6, 7) arranged substantially parallel to the blade (5) constituting the first conductor, the said blades being separated from each other and with respect to the external sleeve by an insulator (3, 4), the earth conductor of the second connector element (2) including an external sleeve (17), and a blade (15) arranged between the blades (14, 16) constituting the second and third conductors, the said blades being separated from each other and with respect to the said external sleeve by an insulator (11, 12).

In this connector, the third conductor is separated from the second conductor when mating the two connector elements, but remains unconnected while the second conductor comes into contact with the first conductor.

There could result from this a coupling effect between the third conductor and the electrical line constituted by the first and second conductors.

In order to avoid this drawback, in the connector described in EP-A-0,590,544, the two blades of the earth conductors join together, in order to form a continuous earth plane between the third conductor and the first and second conductors, when the two connector elements are mated.

This solution nevertheless exhibits the drawback of requiring significant penetration of the first connector element into the second connector element.

It also exhibits the drawback of involving a large radial deflection of the second and third conductors, something which, on the one hand, requires a large enough diameter of the connector and, on the other hand, imposes large bending stresses on the blades constituting the second and third conductors.

SUMMARY OF THE PRESENT INVENTION

The present invention aims to provide a high-frequency electrical connector which is of particularly simple and economic construction and operation, which provides a switching function between two electrical lines while at the same time ensuring good electromagnetic isolation between the latter and which, especially, does not exhibit the drawbacks mentioned hereinabove.

The high-frequency electrical connector according to the invention includes a first connector element comprising a first conductor and an earth conductor, and a second connector element comprising a second conductor, an earth conductor and a third conductor which is in electrical contact with the second conductor when the two connector elements are unmated, the first connector element being designed, when mating it with the second connector element, to move apart the said second and third conductors of the second connector element.

According to the invention, the first, second and third conductors are made in the form of blades, the earth conductor of the first connector element includes a conducting external sleeve and a blade arranged substantially parallel to the blade constituting the first conductor, and the earth conductor of the second connector element includes an external sleeve, and a blade arranged between the blades constituting the second and third conductors.

This electrical connector is characterized in that the blade of the earth conductor of the first connector element is designed so as to be in contact with the third conductor of the second connector element when the two connector elements are mated.

It is understood that, in this way, when the two connector elements are mated, the third conductor does not remain unconnected and therefore that the risk of coupling with the electrical line formed by the first and second conductors is removed, without it being necessary to resort to earth conductor blades which join together in order to form a continuous earth plane between the third conductor and the first and second conductors.

The reason for this is that, in the fitted-together position, the blade of the earth conductor of the first connector element is in contact with the third conductor of the second connector element. This third conductor is therefore arranged outside the high-frequency signal transmission line defined by the second conductor and the blade of the earth conductor of the second connector element, thereby providing good electromagnetic isolation between the electrical lines formed.

Preferably, insulators are provided between the blades constituting the first, second and third conductors and between these blades and the corresponding external sleeve.

In a preferred embodiment, the end of the blade of the earth conductor of the first connector element, the end of the blade of the first conductor and an insulator separating these blades constitute an assembly forming a male terminal capable of being engaged between the ends of the blades constituting the second and third conductors of the second connector element, moving these ends apart.

In a particular embodiment of the invention, the second and third conductors each include two contact areas, namely a first contact area by which they bear against each other when the two connector elements are unmated, and a second contact area by which they bear respectively on the first conductor and on the blade of the earth conductor of the first connector element when the two connector elements are mated.

In this embodiment, the first contact areas lie in the mid-plane of the connector, which plane also contains the earth blades, whereas the second contact areas lie set back with respect to this mid-plane when the two connector elements are unmated.

This results in a small radial deflection of the second and third conductors, when mating the two connector elements, something which makes it possible for the connector to have a smaller diameter and for the bending stresses of the blades constituting the second and third conductors to be limited.

The external sleeves of the first and second connector elements are advantageously dimensioned so as to be mutually in contact when the two connector elements are fitted together. Preferably, the sleeves are designed so that, when fitting together, at least one of the sleeves deforms radially.

The external sleeves provide a screening function with respect to the environment, The blades of the earth conductors of the first and second connector elements are advantageously arranged so as to be in contact by their longitudinal edges with the corresponding external sleeves.

These blades, forming earth planes, advantageously have slits giving them elasticity in their plane in order to ensure good electrical contact with the sleeves surrounding them.

Furthermore, the blades constituting the second and third conductors are preferably configured so as to bear elastically against each other in the unmated position of the connector elements.

For this purpose, at least one of the blades constituting the second and third conductors includes a curved part projecting towards the other blade.

The impedance of each electrical line can be fixed precisely by determining:

a) the cross-sections of the blades constituting the first, second and third conductors;

b) the dielectric constant of the insulation separating the conductors from each other and with respect to the earth conductors;

c) the distances separating the blades constituting the first, second and third conductors from the blades of the corresponding earth conductors.

With the aim of making the invention easier to understand, a particular embodiment of it will now be described, given by way of entirely non-limiting example with reference to the appended drawing in which:

Figure 1:
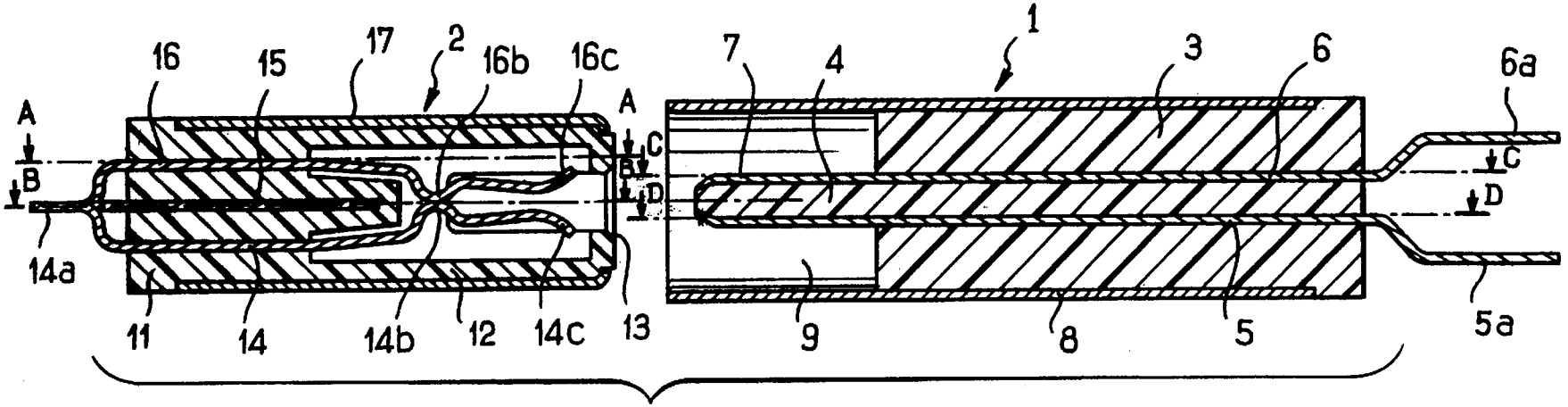
FIG. 1 is an axial sectional view of a connector according to the invention in the unmated position.

B—B defines the mid-plane of the connector.

DETAILED DESCRIPTION OF THE INVENTION

The high-frequency electrical connector according to the invention is constituted by a first connector element designated generally by 1 and by a second connector element designated generally by 2.

These two connector elements will now be described in succession.

The first connector element 1 includes several insulators constituted by an essentially cylindrical body 3 made as a single piece extended at its front part by a projecting part 4 of rectangular cross-section.

Arranged in grooves made in the insulator 3 are, on the one hand, a blade 5 constituting a first conductor and, on the other hand, an earth conductor blade 6.

Figure 5:
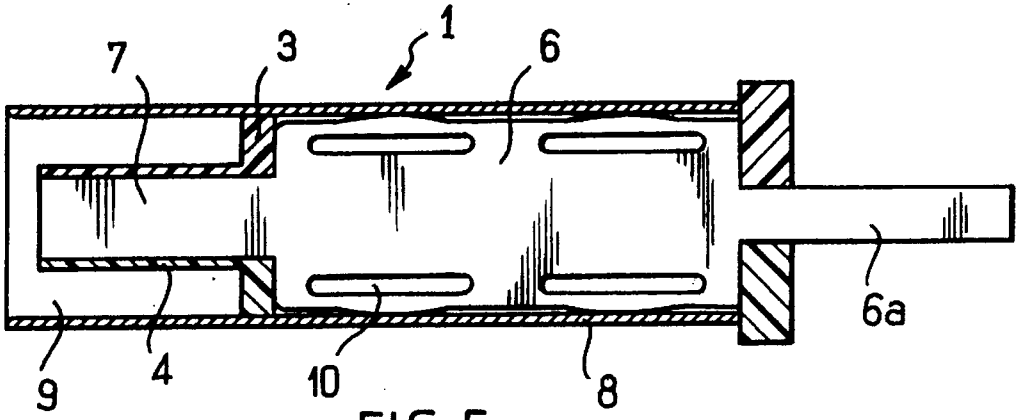
FIGS. 3 to 6 are longitudinal sectional views of the elements of the connector according to the invention, along respectively A—A, B—B, C—C and D—D of FIG. 1.
Figure 6:
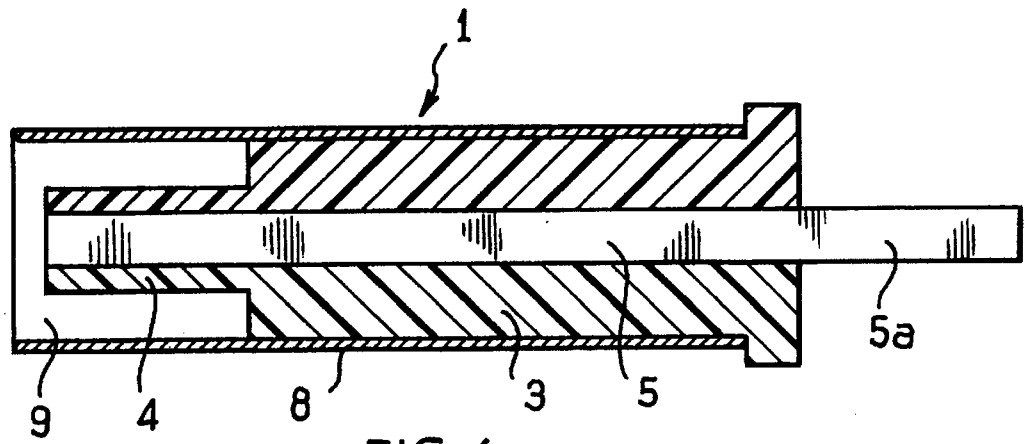
Figure 3:
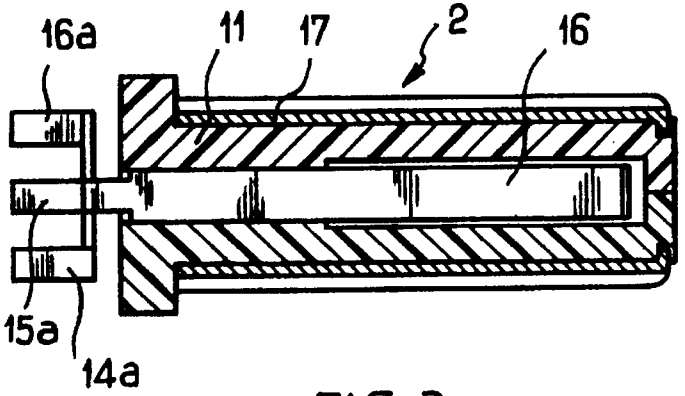
Figure 4:
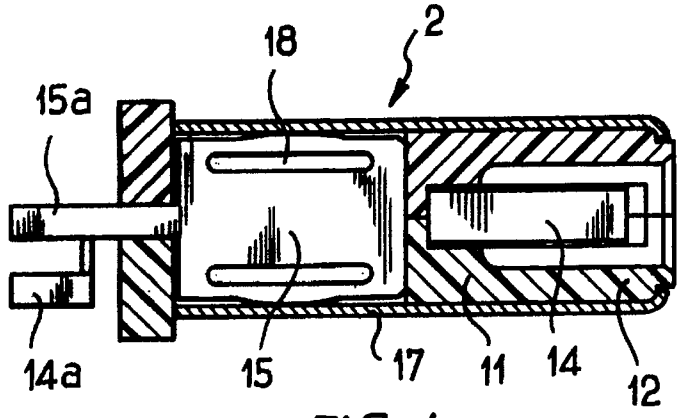

The shape of the blades 5 and 6 is seen most clearly in FIGS. 6 and 5 respectively.

The blade constituting the first conductor 5 is formed from a strip having a substantially constant cross-section over the entire length of the insulating body 3 and terminates at the end of the projecting part 4 of the insulator.

The rear part 5*a* of the blade 5 projecting from the insulating body 3 forms an external connection area.

The earth conductor blade 6 has, over the major part of the length of the insulating body 3, a large width and is extended by a projecting part 7 of smaller width as far as the end of the projecting insulating part 4. At its rear end, the earth conductor blade 6 has a narrower part 6*a* forming an external connection area.

The earth conductor of the connector element 1 furthermore includes an external sleeve 8 surrounding the insulating body 3, being fixed to it by any appropriate means and extending towards the front of the connector element. A cavity 9 is defined in the front part of the external sleeve 8, in which cavity emerges an assembly forming a male terminal, constituted by the insulating projecting part 4, the end 7 of the blade 6 of the earth conductor and the end of the blade 5 constituting the first conductor.

The front end of this assembly forming a male terminal is advantageously chamfered. As may be seen in FIG. 5, the blade 6 is provided with slits 10, being four in number in the example illustrated, giving it elasticity in its plane so as to produce, along the longitudinal edges of the blade 6, bulges for contact with the external sleeve 8.

As may be seen in FIG. 1, the blades 5 and 6 are arranged symmetrically with respect to a diametral plane of the external sleeve 8.

The second connector element, designated generally by 2, includes an insulating body 11 extended by a tubular part 12 provided with an opening 13 of substantially rectangular cross-section. Arranged in grooves in the insulating body 11 are a blade 14 constituting a second conductor and whose rear end 14*a* constitutes an external connection area, an earth conductor blade 15 whose rear end 15*a* constitutes an external connection area and a blade 16 constituting a third conductor and whose rear end 16*a* also constitutes an external connection area.

The earth conductor blade 15 is arranged between the blades 14 and 16 constituting respectively the second and third conductors of the connector according to the invention.

Figure 2:
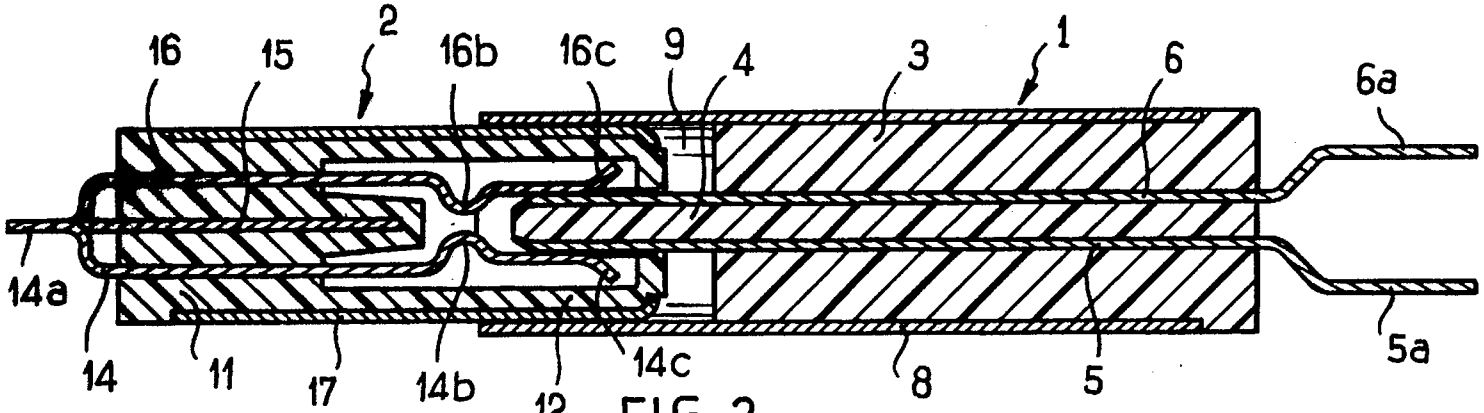
FIG. 2 is an axial sectional view of the connector according to the invention in the mated position.

As may be seen in FIGS. 1 and 2, each of the blades 14 and 16 includes, beyond the end of the blade 15 and the insulating part which surrounds it, respectively a curved part 14*b* and 16*b* made to project and facing the other blade. These curved parts constitute first contact areas in the sense of the invention.

As may be seen in FIG. 1, in the unmated position, the first contact areas 14*b* and 16*b* ensure close elastic contact between the blades 14 and 16. Beyond their curved part, each of the blades 14 and 16 has respectively a part 14*c* and 16*c* which is flared out in the form of a spatula which constitutes a second contact area in the sense of the invention.

The first contact areas lie in the mid-plane of the connector, whereas the second contact areas lie set back with respect to this plane when the connector is mated.

The blades 14 and 16 are formed from a strip having a substantially constant cross-section over the entire length of the connector element.

As with the blade 6 of the first connector element, the earth conductor blade 15 of the second connector element 2 has an appreciably greater width than the blades 14 and 16 in order to come into elastic contact with a peripheral sleeve 17 surrounding the insulator 11, 12 of the second connector element over most of its length as far as close to its end face having the opening 13.

The external sleeve 17 is fixed to the insulator 11, 12 by any appropriate means. The sleeves 8 and 17 of the first and second connector elements are dimensioned so as to cause radial deformation of the sleeve 8 during mating in such a way that, in the mated position illustrated in FIG. 2, good electrical contact is made between the said sleeves.

As with the earth conductor blade 6 of the first connector element, the earth conductor blade 15 of the second connector element includes slits 18, being two in number in the example illustrated, giving it elasticity in its plane in order to come into contact with the internal wall of the external sleeve 17.

The blade 15 is arranged in a diametral plane of the external sleeve 17 and the blades 14 and 16 are arranged symmetrically with respect to this diametral plane.

During mating, the assembly forming the male terminal, described previously, of the first connector element penetrates into the orifice 13 and engages between the end parts of the blades 14 and 16, moving them apart so that the first contact areas **14*b* and 16*b*** are no longer in contact.

The electrical continuity between the blades 14 and 16 is thus broken and electrical continuity is provided by the second contact areas, on the one hand, between the blades 5 and 14 and, on the other hand, between the end 7 of the blade 6 and the blade 16.

Upon unmating, the arrangement of FIG. 1 is re-established in which, as regards the second connector element, electrical continuity is provided between the blades 14 and 16 by the first contact areas.

Although the invention has been described in relation to a particular embodiment, it is quite obvious that it is in no way limited thereto and that various alternative forms and modifications may be made to it without departing either from its scope or its spirit.

I claim:

1. A high-frequency electrical connector comprises:

(a) a first connector element (1) including a first conductor (5) and an earth conductor (6), and (b) a second connector (2) element including a second conductor (14) an earth conductor (15) and a third conductor (16) which is in electrical contact with the second conductor (14) when the two connector elements (1,2) are unmated, (c) the first connector element (1) being adapted, when mating with the second connector element (12) to separate said second and third conductors (14, 16) of the second connector element (2), (d) the first, second, and third conductors (5,14,16) being formed as blades, (e) the earth conductor (6) of the first connector element (1) including an external sleeve (8) and being in the form of a blade arranged substantially parallel to the blade (5) constituting the first conductor, (f) the earth conductor (15) of the second connector element (2) including an external sleeve (17) and a blade (15) arranged between the blades (14, 16) constituting the second and third conductors, (g) wherein the blade (6) of the earth conductor of the first connector element (1) is adapted to be in contact with the third conductor (16) of the second connector element (2) when the first and second connector elements (1,2) are mated.

2. Connector according to claim 1, wherein the end of the blade of the earth conductor of the first connector element, the end of the blade constituting the first conductor and an insulator separating the said blades constitute an assembly forming a male terminal capable of being engaged between the ends of the blades constituting the second and third conductors of the second connector element, moving these ends apart.

3. Connector according to claim 1, wherein the blades of the earth conductors of the first and second connector elements are arranged so as to be in contact by their longitudinal edges with the corresponding external sleeves.

4. Connector according to claim 3, wherein the said earth conductor blades of the first and second connector elements have slits giving them elasticity in their plane in order to ensure good electrical contact with the sleeves surrounding them.

5. Connector according to claim 1, wherein the blades constituting the second and third conductors of the second connector element are configured so as to bear elastically against each other in the unmated position of the connector elements.

6. Connector according to claim 5, wherein the blades constituting the second and third conductors each include a first contact area by which they bear, one blade against the other, when the two connector elements are unmated and a second contact area by which they bear, one on the first conductor and the other on the blade of the first connector element, when the two connector elements are mated.

7. Connector according to claim 6, wherein the first contact areas lie in the mid-plane of the connector whereas the second contact areas are set back from this mid-plane when the two connector elements are unmated.

8. Connector according to claim 6, wherein the first and/or the second contact areas are constituted by a curved part projecting towards the mid-plane of the connector.

* * * * *